US006089309A

United States Patent [19]

Ge

[11] Patent Number: 6,089,309

[45] Date of Patent: Jul. 18, 2000

[54] METHOD FOR MANUFACTURING GRADIENT MATERIAL BY CONTINUOUS AND SEMI-CONTINUOUS CASTING

[75] Inventor: Yu Ge, Guang Zhon, China

[73] Assignee: South China University of Technology, Guangdoing, China

[21] Appl. No.: 09/060,557

[22] Filed: Apr. 15, 1998

[30] Foreign Application Priority Data

Apr. 15, 1997 [CN] China ..... 997103553

[51] Int. Cl.[7] ..... B22D 11/041; B22D 11/103

[52] U.S. Cl. ..... 164/461; 164/488

[58] Field of Search ..... 164/461, 419, 164/488

[56] References Cited

U.S. PATENT DOCUMENTS 3,262,161 7/1966 Andrzejak et al. ..... 164/425

FOREIGN PATENT DOCUMENTS 0 596134 5/1994 European Pat. Off. ..... 164/461

41 08 203 9/1991 Germany .

54-102235 8/1979 Japan ..... 164/461

63-174764 7/1988 Japan ..... 164/488

2-55641 2/1990 Japan ..... 164/461

3-281043 12/1991 Japan ..... 164/461

4-274845 9/1992 Japan ..... 164/461

5-50187 3/1993 Japan ..... 164/461

732115 6/1955 United Kingdom .

*Primary Examiner*—J. Reed Batten, Jr.

*Attorney, Agent, or Firm*—Knobbe, Martens, Olson & Bear, LLP

[57] ABSTRACT

A gradient material is manufactured in which the alloy composition varies continuously with the cross-section. A first metal liquid is introduced from a first tundish into the outer portion of a water-cooled mould. A second metal liquid is introduced into the inner portion of the water-cooled mould through a refractory entry nozzle immersed in the first metal liquid to form a metal liquid pool. The metal liquid pool is solidified into an ingot where the composition of alloys varies continuously from the inside to the outside of the ingot.

9 Claims, 4 Drawing Sheets

(a)

(b)

(c)

(d)

METHOD FOR MANUFACTURING GRADIENT MATERIAL BY CONTINUOUS AND SEMI-CONTINUOUS CASTING

The present invention relates to technology of manufacturing alloy materials, in particular, the method for manufacturing gradient material by way of continuous and semi-continuous casting employing multi-liquid teeming, in which material, the alloy composition is continuously distributed over the cross-section of the casting. This method can be used either for producing conventional metallic structural materials, the ingots of which are made by continuous casting, or for manufacturing gradient functional materials with metallic and non-metallic components, as well as for manufacturing ingots or semiproducts of various geometrical shapes.

In engineering, especially in many applications in high-tech sections, there are entirely different quality requirements on different positions of the material. Quite common is the distinct quality requirements on surface and core portion of the material. The traditional solutions are simply two ways: either using a high rank material with overall good combined quality, or making additional surface modification treatments. Both ways will surely bring about waste of materials or energy, causing marked rise in cost.

Though various composite casting processes in common use for manufacturing bushes and rollers also employ multiple metal liquid teeming, yet the multi-liquid teeming in all of the traditional composite casting processes is carried out in a non-continuous way, that is, the liquids are being teemed successively one after another. Only after the first teemed metal is solidified into an outer crust, the other metal liquid is teemed. The microstructure produced by this composite casting correspond to a transition layer sandwiched between two metals, having not the characteristics of continuous gradient variation of the composition.

British patent GB732115 put forward a conception of producing composite materials by way of continuous casting. No doubt this method also uses different smelting furnaces to produce two liquids of great difference in composition, namely, aluminum and aluminum oxide, but the two liquids are being sufficiently stirred in the tundish, before entering the mould. The structure produced by this method is a mixture, the macrosection of which is uniform the whole body through, utterly without any characteristics of the gradient material with its inner and outer composition being continuously varied.

The German patent application (laid open) DE4108203A1 put forward first a conception of manufacturing, by way of continuous casting an alloy material whose composition presents a gradient variation. This method is characterized in adopting a two-stage crystallization, namely, providing two moulds, a preliminary mould and a secondary mould. At first, different molten metals are being cooled in their respective preliminary mould and effected a partly solidification. The partly solidified different metal blanks are then transferred to a common secondary mould. The invention suggests that in the secondary mould, different metals, when joining together, will pack and press with each other, causing crushing of the solidified thin crust and local re-smelting, so that the partial mixing occur between different metals, and macrostructures after solidification present a continuous distribution of the composition. However, the actual situation shows that as the partly solidified metal blank has already hardness and strength to a certain degree, it is surely very difficult in technology to bend the two (or more) kinds metal blanks having already solidified thin crust and to introduce them to a same secondary mould, so is it, up to the present, not yet put into practice.

The object of the present invention is to overcome the deficiencies of the prior arts, and to provide a method for manufacturing gradient material, the alloy composition of which can be varied continuously with the cross-section of the workpiece in accordance with the actual quality requirement. This method is based on the current continuous and semi-continuous casting and needs only appropriate modifications to the teeming system. It has marked economical benefits and excellent operability, the equipment employed being simple, and is therefore suitable for industrial use.

The objects of the invention can be achieved by the following measures:

1. manufacturing gradient material by way of continuous and semi-continuous casting, characterized in that a plurality of different metal liquids are introduced continuously into a same mould by way of the separated gates, solidified in sequence forming a single body, and drawn in constant speed by dummy ingot.

2. Two sets of teeming systems disposed internally and externally are being employed for the double flow teeming of two different metal (or non-metal) liquids. The external metal liquid enters directly the water-cooled mould via the tundish, while the inner layer metal liquid also flows into the same mould through the immersed refractory entry nozzle and the contents solidifies sequentially starting from the wall of mould. The outer layer metal liquid first starts to solidify into a thin crust, creating a continuous variation of the alloy compositions in the as-cast structure from the outer part to the inner part.

3. to affect the solidifying temperature of metal by changing the composition of the metal liquids, and to affect the actual temperature field by changing the cooling intensity and the teeming temperature, and the two affecting factors are combined to adjust the shape of the liquid pool effecting a layer-by-layer solidification in sequence.

4. adjusting the compositions distribution curve of the solidified structure by changing the separated gates or changing the immersion depth of the entry nozzle;

5. carrying out degassing softening treatment in accordance with the current industrial standard during the metallurgical treatment stage inside and outside the smelting furnace.

6. applying low pressure protecting gas to the metal liquids in the tundish during the whole casting process;

7. the flow rate of the inner layer metal liquid is to be adjusted by changing the diameter of the throttle opening of the inner entry nozzle, and the flow rate of the outer layer metal liquid is to be controlled indirectly by the total substance flow rate defined by the ingot drawing speed and the flow rate of the inner layer metal liquid, 8. using a special-shaped dummy bar head and covering it with heat protective refractory material of a certain thickness to help forming favorable shape of liquid pool shape in the stage of ingots drawing.

The present invention has the following advantages as compared with the prior arts:

1. The present invention can in one step in as-cast state realize the continuous variation of alloy composition along the cross-section of materials in accordance with the actual property requirements, effectively and economically solving such problems as the different requirements for to different positions of the materials. Taking the iron and steel structural material as an example, the typical quality requirement in actual practice is hard for the outer portion and tough for the inner portion, and the present method can make the carbon element progressively and smoothly decrease from the outer portion to the inner portion, achieving the goal of higher strength for the surface part and good toughness for the inner part, so as to double and redouble the fatigue life of the material. As for the anticorrosion problem of the iron and steel material, the present method amasses such alloy elements as nickel and chromium only on the surface in the as-cast structure, not only ensuring the anti-corrosion property, but also improving the toughness of the material, bestowing on it an excellent combined property.

2. In contrast to the German patent application (laid open) DE4108203A1, the present invention solves the main difficulties in the technology of producing gradient materials by way of continuous casting, namely: (1) teeming a number of metal liquids into a same mould and effecting a layer by layer solidification in sequence by means of characteristics of the temperature field formed by the heat flow conduction; (2) curbing the convection between the metal liquids, so that only a partial mixing rather than the entire mixing occurs; (3) taking advantage of the characteristics of strong atomic diffusion ability in liquid state and in high temperature range of solid state. The internal interfaces between different metal liquids are made to vanish by the atomic diffusion during the solidification and cooling processes, and a continuous smooth distribution of composition is formed, (4) taking advantage of the characteristic of weak atomic diffusion ability around room temperature, the diffusion will not be going on further within a limited time period, so that a stable distribution of composition is obtained.

3. The equipment for the present method is simple, the operability being good, the existent continuous and semi-continuous casting production line can continue to be used, only an appropriate modification of the teeming system is needed. The economic benefit for this method is remarkable. In the present method, when being used in the production of steel products, it is probably possible to use low alloy steel instead of high alloy steel, or it may be used to substitute for surface treatment. All of which will bring about remarkable reducing of cost.

4. This method is widely applicable. It can be used in manufacturing steel products and iron-based alloy semi-products, and also in manufacturing composite gradient functional material of metal and non-metal, creating a new prospective concept for the materials scientist developing materials. The principles of this method can be used for materials with two or more than two metals (or non-metals). Although it does not mention herein embodiments of continuous casting with composite teeming of three or more than three liquids, yet there is no difference in principle except in the technological process where additional teeming system and smelting units are needed.

Figure 5:
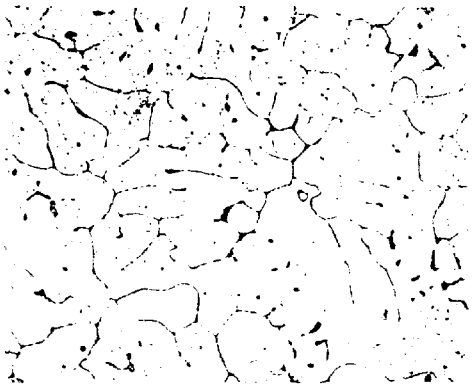
Figure 5:
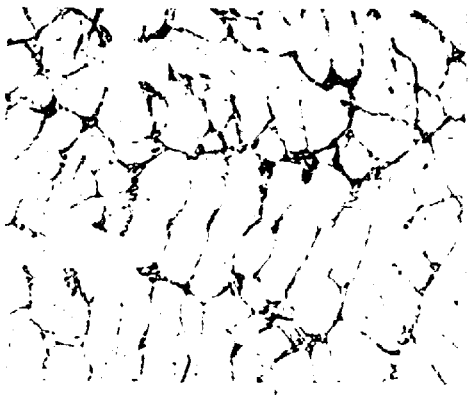
Figure 5:
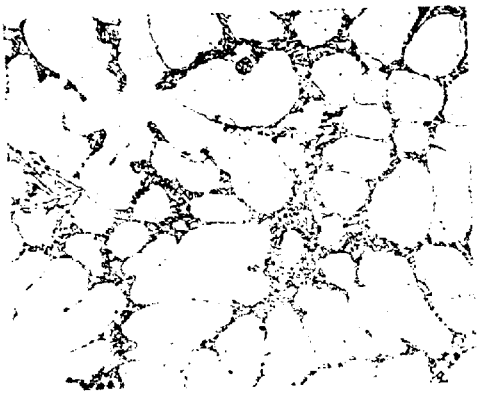
Figure 5:
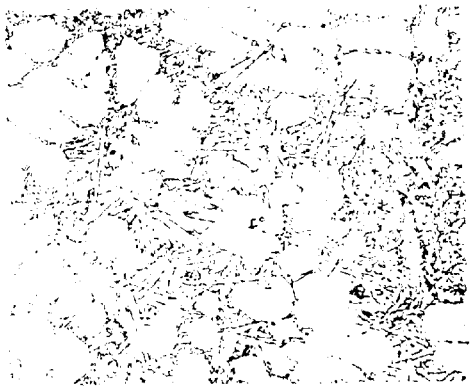

FIGS. 5(*a*)–5(*d*) show a set of micrographs representing the continuous variation from the outside to the inside of the metallographical structure of the aluminum silicon gradient material (the first set of alloy in Table 1) in which 5(*a*) the position 5 mm from the center; 5(*b*) the position 10 mm from the center; 5(*c*) the position 20 mm from the center, and 5(*d*) the position 30 mm from the center.

The following is a further detailed description of the present invention through embodiments and drawings.

The principle of the present invention can be used in continuous casting with two or more than two metallic or non-metallic liquids, and the major application prospect lies in the various iron and steel material which are made into ingots nowadays in great amount by way of continuous casting. The manufactured ingots or semi-finished section materials are allowed to have various different geometrical sections. As the object of this embodiment is only to explain further the fundamental principles, to know well the fundamental conditions of the formation of the composites gradient distribution, the aluminum silicon alloy, aluminum copper alloy and aluminum magnesium alloy which have the good metallurgical operability are taken as experimental samples. Table 1 lists the four alloy systems which have been experimentally studied by embodiments. Meanwhile, the simple circular shape is taken for the ingot made from double liquids teeming. And the disposition of metal for the inner and outer layers is designed to be the simplest, namely, the inner layer metal liquid is brought to the geometrical center of the outer layer metal liquid.

Figure 1:
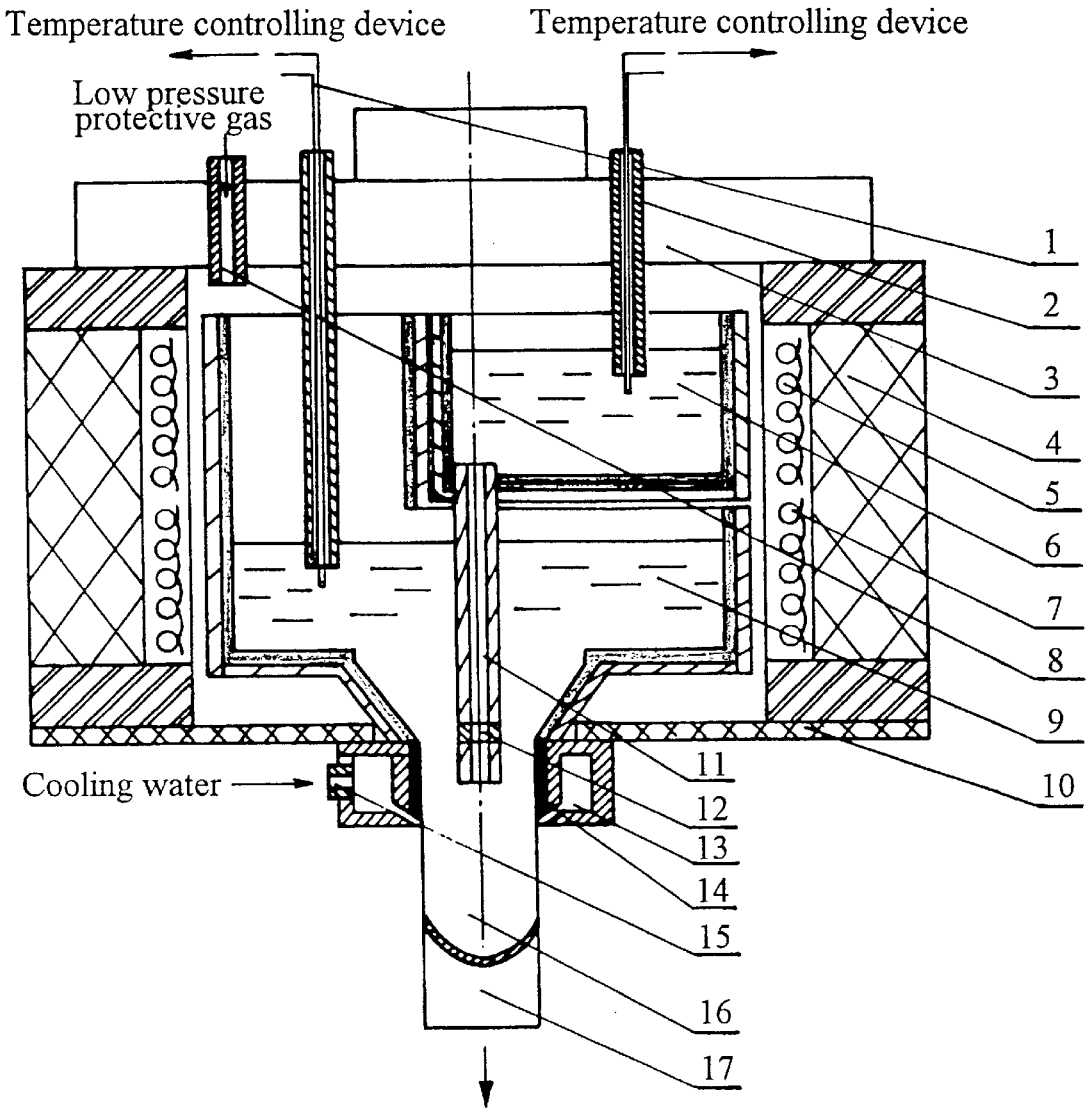
FIG. 1 is a schematic diagram showing the manufacturing of gradient material by way of continuous and semi-continuous casting employing double liquid teeming.
Figure 2:
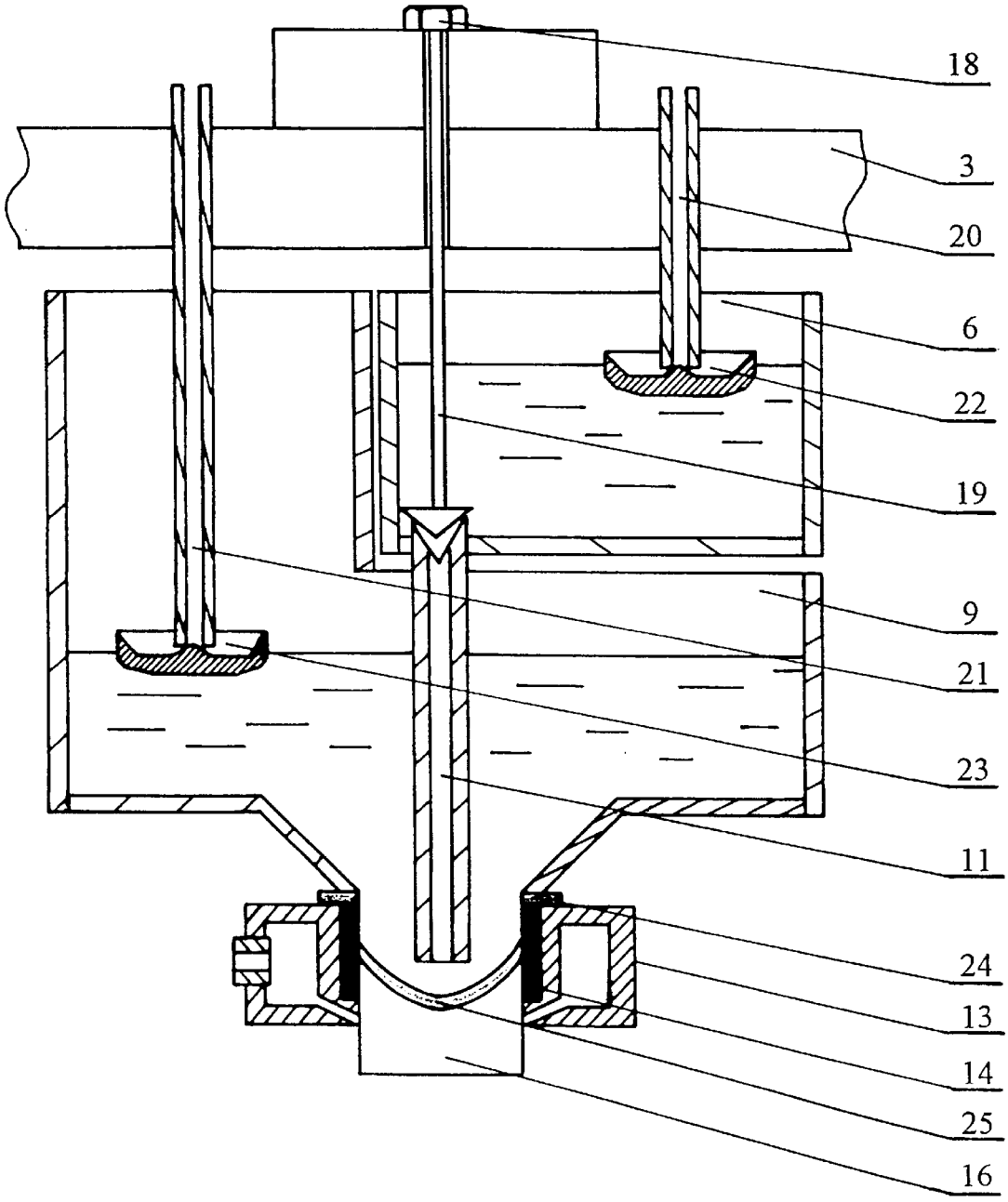
FIG. 2 is a schematic diagram showing the relationship of the teeming system with other units.

As shown in FIG. 1 and FIG. 2, the reference numeral 3 stands for the cover of the heating device, 4 the heat-isolating layer, and 10 the bottom of the heating device. Two kinds of different metal liquids are smelted respectively in different smelting furnaces until they reach the metallurgical quality. The outer layer metal liquid is introduced into the outer tundish 9 via outer gate 21 by way of the separated gates. The outer tundish 9 is directly connected with the mould 14, so the metal liquid can directly fill the mould. The inner layer metal liquid is introduced into the inner tundish 6 via inner gate 20. The metal liquid in the inner tundish 6 fills the mould through the inner entry nozzle 11 which is immersed in the outer tundish 9 and the mould 14. Under the strong cooling of pressure water, the metal liquid solidifies from the outer part to the inner part layer-by-layer throughout the mould 14 into an integral body. The mould 14 is separated from the outer tundish 9 by the thermal insulated gasket 24. The solidified metal 16 is drawn away in constant speed by a dummy ingot. A plurality of compositions of the inner and outer layer of metal liquids for the embodiments can be seen in Table 1. All the experiments in the embodiments employ a cylindrical graphite mould with a diameter of 63 mm and a manual operated hoist for the dummy ingot.

The two prerequisites for realizing the gradient distribution of the composition in the as-cast structure are to ensure a progressively layer-by-layer sequential solidification and to effectively curb convection. The remaining technological measures and conditions for carrying out the present method comprise:

1. The liquid level in each tundish is to be kept stable by using body controller 22 and 23, so that the difference between the gravity water heads of the liquids in the two tundishes are being kept constant.

2. Two sets of thermocouple 1, 2, two sets of electric heating windings 5, 7 and additional temperature controlling means are used to adjust and keep the temperature constant. The two sets of electric heating windings 5, 7 are disposed separately at the upper and lower parts, so that the temperature in each of the tundishes can be adjusted separately. The holding temperature range in the tundish of the embodiments are listed in Table 1. The inner tundish has higher degree of overheating so as to help bringing about the trend of sequential solidification.

3. With respect to double flow teeming, the flow rate of the inner layer metal liquid is determined by the diameter of the throttle opening of the inner entry nozzle 11. There are two ways to provide the dimension of the throttle opening: one is to use a throttle opening plate 12, the diameter of the opening being fixed for which there is no need to readjust the production process; the other is to use a plug bar 19 by turning the regulating nut 18 to move the plug bar 19 up and down, the flow rate can be adjusted during the production process. The outer layer metal liquid directly entering the mould is in a "self-flow" state. The flow rate of the outer layer metal liquid equals to the balance between the total substance flow rate determined by the drawing speed of ingots and the above-mentioned inner layer metal liquid flow rate determined by the throttle opening diameter. The so-called "self-flow" here means that the liquid flows downward under the action of gravitation to fill the mould without providing a throttle device. The ingot drawing speed in this embodiment is 12~18 cm/min.

Figure 4:
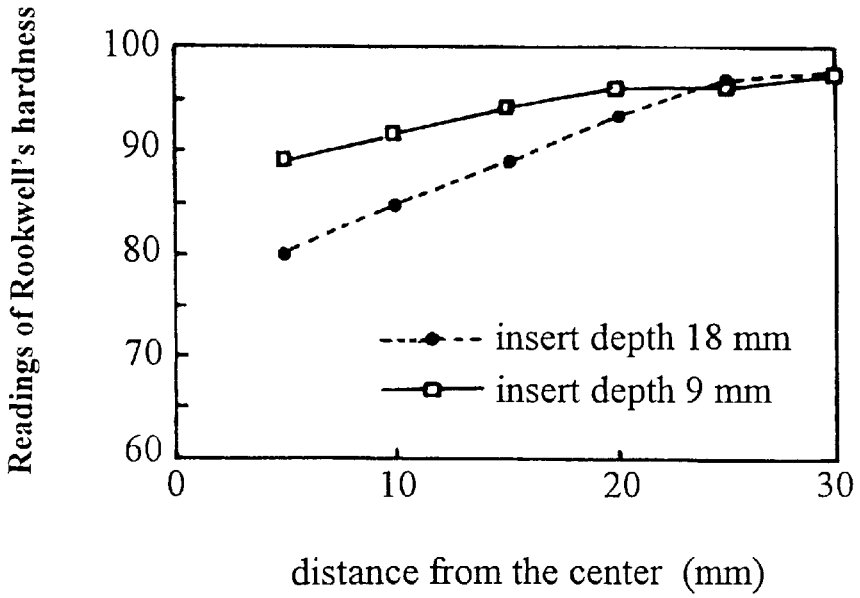
FIG. 4 shows a set of curves reflecting the effects of the Immersion depth of inner entry nozzle on the hardness distribution in the aluminum silicon systems (the first set of alloy in Table 1).

4. While controlling the sequential solidification by this method, it has to consider the effects on the shape of the liquid pool before solidification by the two links of actual temperature field and the solidification temperature of the alloys themselves. There are a number of measures that can be used to adjust the actual temperature field, for example, to change the pressure and the flow rate of the cooling water entering the mould water jacket 13 from the water inlet 15, to change the immersion depth of the inner entry nozzle 11, to change the temperature of the different metal liquids during their residence in the tundishes 6, 9, to change the ingot drawing speed, and to change the dimension and structure of the mould 14. All these measures can influence directly or indirectly the distribution of the actual temperatures in the crystallization area. However, the change of alloy composition of the different metal liquids and the flow rate ratio of the different metal liquids would influence the temperature of solidification of the alloys, this is because, for most of the alloy materials, the liquidus line will drop along with the composition. FIG. 4 shows the influence of the immersion depth of the inner entry nozzle 11 of the embodiment on the distribution curve of the alloy compositions.

5. There are two major measures to be taken to keep the flowing mode of the metal liquids smooth and steady and to prevent the different metal liquids from lateral flow: (1) to seal up the whole die heating device of FIG. 1, and introducing low pressure protective gas via the inlet 8, (2) to carry out a more thoroughgoing degassing and refining treatment in accordance with the norm during the metallurgical treatment stage inside and outside the smelting furnace, so as to minimize the convection phenomenon aggravated by the rising of gas bubbles in the smelt.

6. A dummy bar head 17 with depressed cavity similar to the shape of the liquid pool is used, the surface of the cavity being covered with a layer of thermal protective and fireproof coating 25. Such a specially shaped dummy bar head enables the inner pouring tube to have sufficient immersion depth at the beginning of casting, and also to form a stable liquid pool more rapidly.

Figure 3:
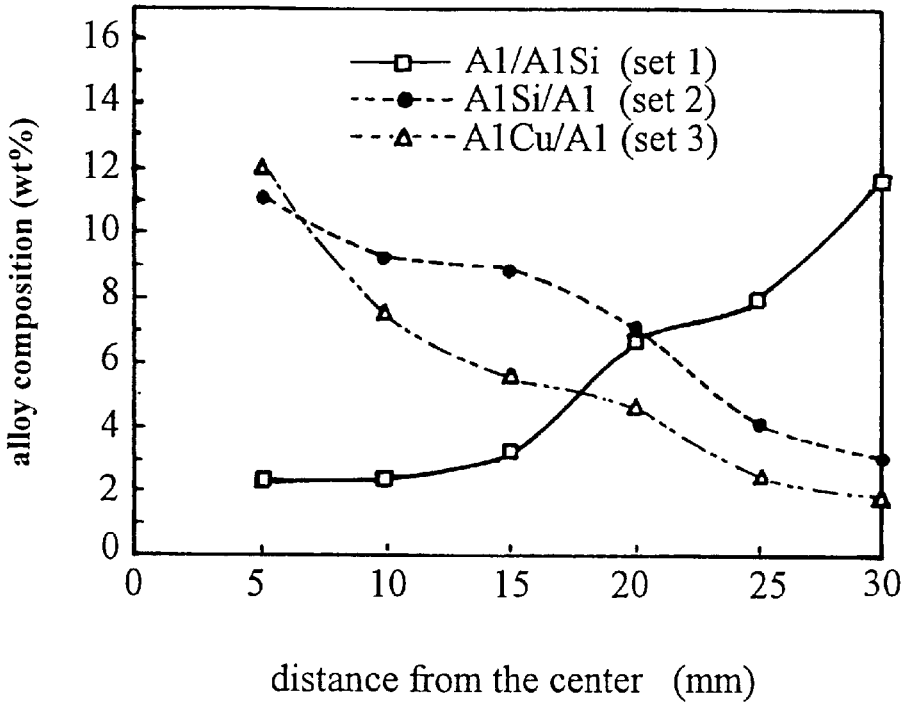
FIG. 3 shows a set of curves with different series of alloy composition varying with the cross-section for various alloy systems (immersion depth of the inner entry nozzle being 18 mm, the remaining parameters as listed in Table 1).

The test sample for analysis in this embodiment is to be taken after the dummy bar head starts for 1 m. FIG. 3 to FIG. 5 show a part of the results. FIG. 3 reflects the curves showing the alloy composition of the test samples taken from different alloy systems varying with the cross-section, wherein the silicon composition of Set 1 decreases progressively and evenly from is outside to inside, and the silicon and copper compositions of Set 2 and Set 3 increase continuously from outside to inside. FIG. 4 is a set of curves of Rockwell's hardness distribution for the test samples of aluminum and silicon systems (Set 1 in Table 1), reflecting the influences of different immersion depths of the inner entry nozzle on the composition distribution. FIG. 5 is a set of micrographs showing the metallographical structure on different positions of the same test sample. It can be seen from the results of all these analyses that the test samples prepared by the embodiments all present a trend of continuous variation with the cross-sections for the alloy compositions, for mechanical properties and for metallographical micro structures. The embodiments prove that the present invention is feasible in theorem, yet not complicated in operation.

TABLE 1

The Alloy Compositions and the Holding Temperatures of the Tundish Used in the Embodiments

| Alloy Series No. | Composition of Inner Layer Metal | Temperature in Inner Tundish | Composition of Center Layer Metal | Temperature in Center Tundish |
|---|---|---|---|---|
| Set 1 | commercially pure aluminum | 750~800° C. | Al-12 wt % Si | 700~750° C. |
| Set 2 | Al-12 wt % Si | 720~770° C. | commercially pure aluminum | 720~770° C. |
| Set 3 | Al-10 wt % Cu | 750~800° C. | commercially pure aluminum | 720~770° C. |
| Set 4 | Al-5 wt % Mg | 720~770° C. | commercially pure aluminum | 720~770° C. |

What is claimed is:

1. A method for manufacturing gradient material, comprising:

continuously introducing a first metal liquid from a first tundish at a first rate into an outer portion of a water-cooled mould, wherein said first metal liquid is at a first temperature and wherein said first metal liquid flows directly from said first tundish into said outer portion of said water-cooled mould;

continuously introducing a second metal liquid at a second rate into an inner portion of said water-cooled mould through a refractory entry nozzle immersed in said first metal liquid to form a metal liquid pool, wherein said second metal liquid is at a second temperature and wherein said nozzle has an adjustable diameter;

solidifying said first and said second metal liquids forming said metal liquid pool into an ingot comprising a plurality of alloys of the first and second metals, wherein a composition of said plurality of alloys varies continuously with a distribution from an inside of said ingot to an outside of said ingot; and drawing said ingot from said water-cooled mould at constant speed.

2. The method for manufacturing gradient material according to claim 1, wherein said second metal liquid is introduced into said refractory entry nozzle from a second tundish containing said second liquid metal.

3. The method for manufacturing gradient material according to claim 1, wherein said first metal liquid solidifies into a thin crust next to said water-cooled mould.

4. The method for manufacturing gradient material according to claim 3, wherein said first and said second metal liquids forming said metal liquid pool solidify sequentially into said ingot comprising said plurality of alloys starting from said water-cooled mould.

5. The method for manufacturing gradient material according to claim 1, wherein a solidifying temperature of said plurality of alloys is dependent on a composition of said first and said second metal liquids.

6. The method for manufacturing gradient material according to claim 1, wherein the second rate of continuously introducing said second metal liquid is adjusted by changing the diameters of said refractory entry nozzle.

7. The method for manufacturing gradient material according to claim 1, wherein the distribution of the composition of said plurality of alloys is adjusted by changing the first rate at which said first metal liquid is continuously introduced compared to the second rate at which said second metal liquid is introduced.

8. The method for manufacturing gradient material according to claim 1, wherein the distribution of the composition of said plurality of alloys is adjusted by changing an immersion depth of said refractory entry nozzle.

9. The method for manufacturing gradient material according to claim 1, wherein the first rate of continuously introducing said first metal liquid is controlled indirectly by controlling the constant speed of drawing said ingot and the second rate of continuously introducing said second metal liquid.

* * * * *